United States Patent [19]

Stewart

[11] Patent Number: 5,054,804

[45] Date of Patent: Oct. 8, 1991

[54] COLLAPSIBLE HITCH

[75] Inventor: Thomas Stewart, Asheville, N.C.

[73] Assignee: Trinity Industries, Inc., Dallas, Tex.

[21] Appl. No.: 530,645

[22] Filed: May 30, 1990

[51] Int. Cl.[5] ..... B62D 53/10

[52] U.S. Cl. ..... 280/435; 280/432; 410/64

[58] Field of Search ..... 280/432, 435, 436, 434; 410/64

[56] References Cited

U.S. PATENT DOCUMENTS

| | | | |
|---|---|---|---|
| 3,346,223 | 10/1967 | Broling | 410/64 X |
| 3,358,954 | 12/1967 | Smith et al. | 410/64 X |
| 3,892,426 | 7/1975 | Ferris | 280/432 |
| 4,225,276 | 9/1980 | Stoller et al. | 280/432 X |
| 4,375,894 | 3/1983 | Hammonds | 410/64 X |
| 4,907,815 | 3/1990 | Hunger | 280/436 X |

*Primary Examiner*—Charles A. Marmor
*Assistant Examiner*—Paul Dickson
*Attorney, Agent, or Firm*—Myers & Assoc., Ltd.

[57] ABSTRACT

A king pin locking plate assembly having a locking plate provided on the underside with a pair of cooperating jaws pivotally supported under the locking plate and being urged into open position by a spring member positioned between the two jaws, the two jaws having a frontal portion facing a king pin, the frontal portion defining a lock surface which is adapted to be abutted by a free end of a jaw lock pivotally supported in the king pin receiving slot by a pivot which engages a bifurcated end of the jaw lock. A jaw lock stop is situated in the bifurcated end of the jaw lock and, because of its internal elongated opening, is capable of maintaining the jaw lock in either a king pin securing position or in a king pin releasing position.

6 Claims, 3 Drawing Sheets

2
2
11
11
20
22
24
26
28
30
32
34
36
38
40
42
44
46
47
48
48
50
52
54
56
58
60
62
64
170
172
172
174
176
178
178
178
180
182
184
184

Fig. 2
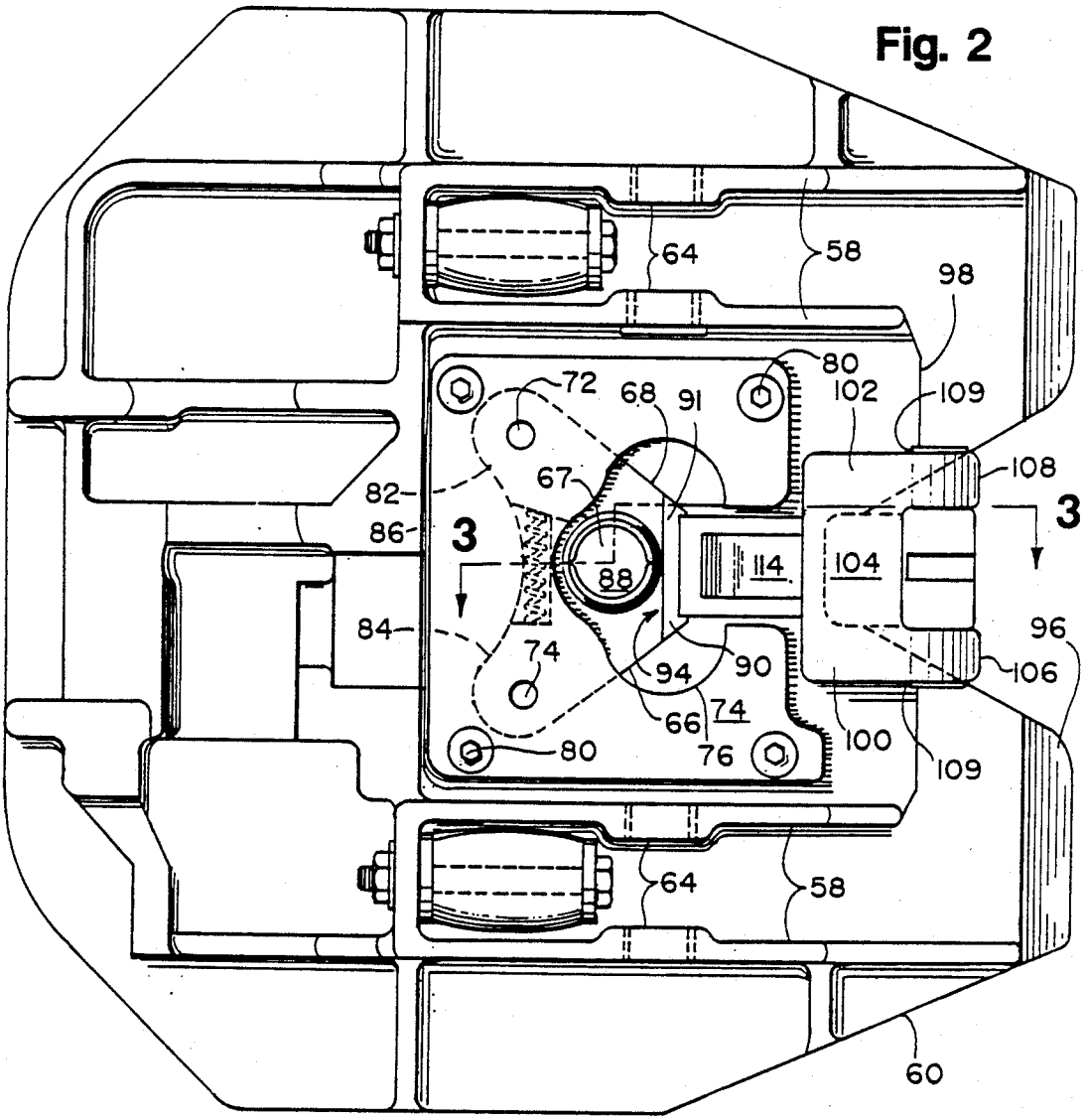
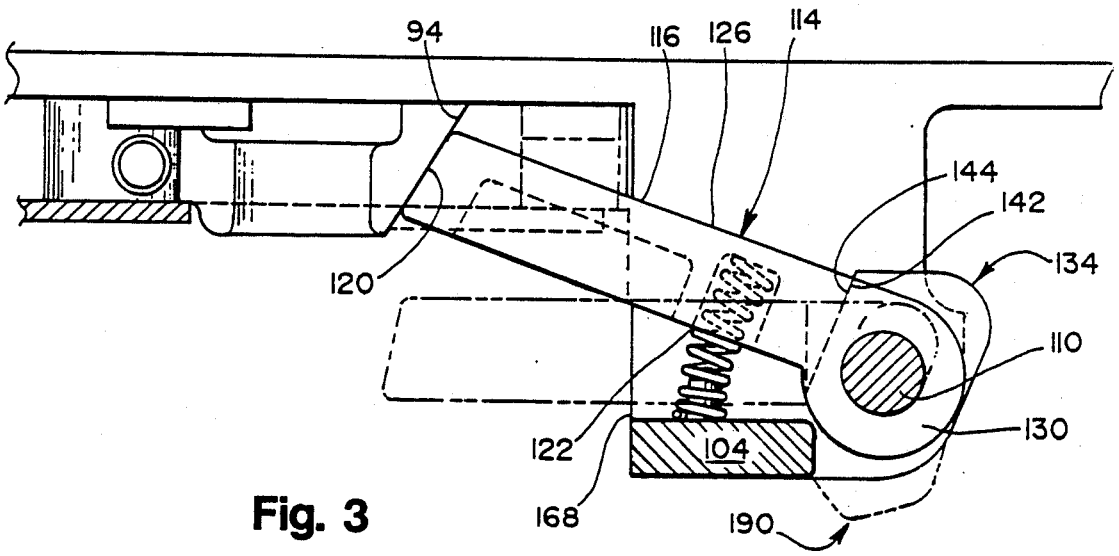
Fig. 3

Fig. 4
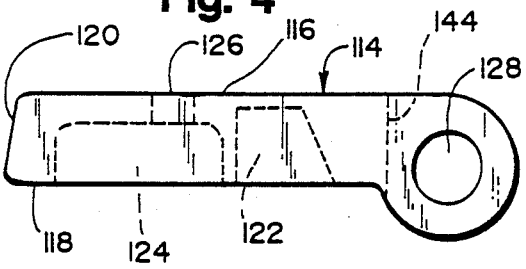
Fig. 5
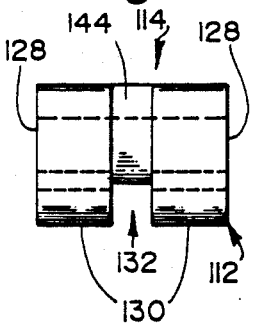
Fig. 6
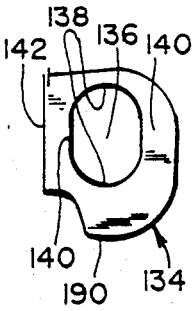
Fig. 7
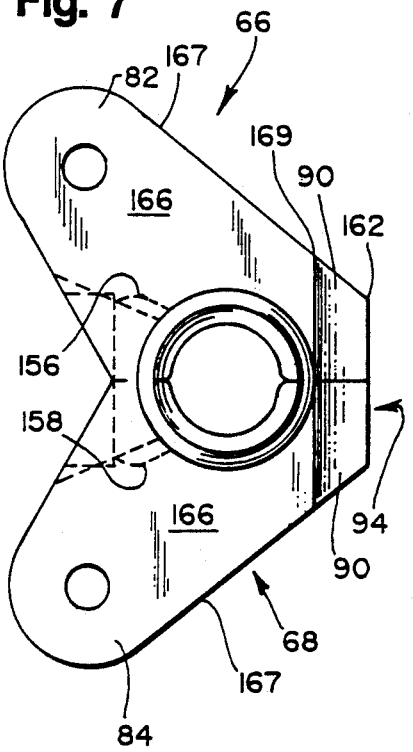
Fig. 9
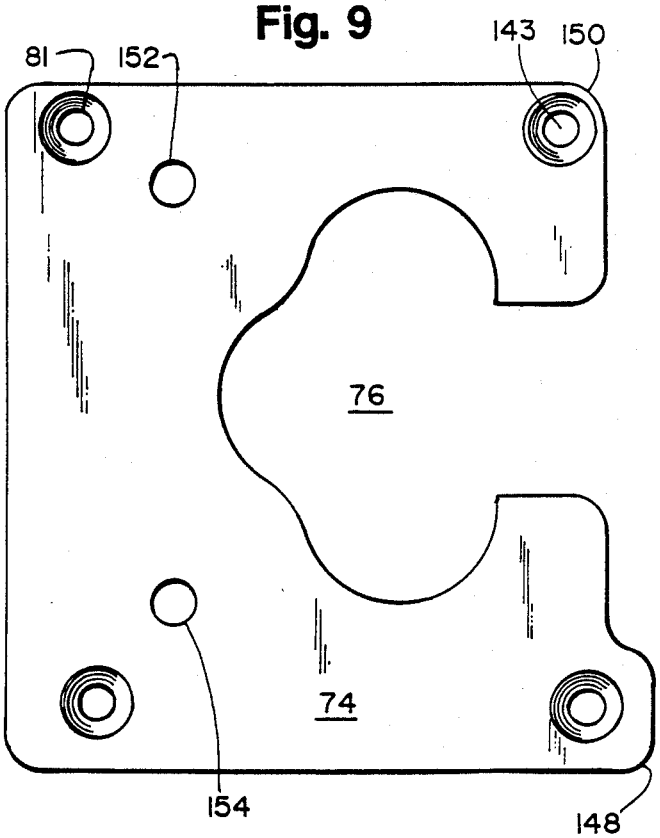
Fig. 8
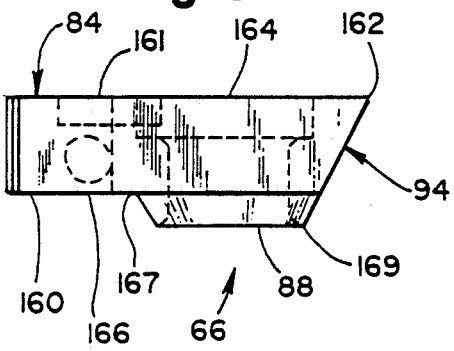
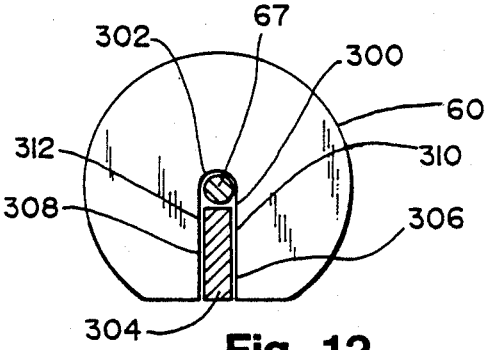
Fig. 12

COLLAPSIBLE HITCH

BACKGROUND OF THE INVENTION

1. Field of the Invention

This invention relates to a collapsible support for containers, semi-trailers, and the like, and particularly to a collapsible support or hitch having a supporting mounting plate or "fifth wheel" designed to engage a king pin or like of the containers, such as highway semi-trailers which are loaded upon railway cars or marine vessels for transport, the collapsible support having a low profile when it is in the storage position to accommodate the passage thereover of vehicles having low ground clearance, and to allow the stowage of cargo containers on top of the collapsed hitch. Particularly, the "fifth wheel" which is a king pin locking plate, is provided with an anti-jackknife device.

2. Description of the Prior Art

Many forms of anti-jackknive devices are available. For example, U.S. Pat. Nos. 3,430,986 and 3,985,369 describe the use of king pin locking plates in conjunction with modified apparatus of the tractors provided with brakeshoes and brakes for controlling the lateral movements of the trailer with respect to the tractor. Such arrangements are quite complex and expensive, and require either hydraulic or electrical power to control the braking application. Another anti-jackknive apparatus is described in U.S. Pat. No. 3,837,678, wherein a king pin locking plate is provided with a longitudinal recess for receiving a king pin on the trailer, which is then locked by an elongated locking member positioned in the recess and operated by a hydraulic assembly mounted on the trailer. Such anti-jackknive devices are satisfactory. However, they require that all trailers be equipped with a hydraulic arrangement activated by a power source on the tractor. Another form of anti-jackknive apparatus is described in U.S. Pat. No. 4,790,556, wherein a king pin locking plate has a longitudinal groove for receiving a king pin on the trailer, the king pin subsequently being secured by an anti-jackknifing abutment inserted into the recess and operated by a fluid-operated cylinder mounted on the trailer. This type of an arrangement is similar to the other discussed hydraulically operated device having the disadvantage of requiring a trailer to be equipped with a fluid cylinder for effecting proper closure of the king pin in the king pin locking plate.

SUMMARY OF THE INVENTION

It is the main object of the invention to provide a king pin locking plate assembly which includes an anti-jackknive device without requiring any power applied support from the trailer or tractor.

Another object of the invention is to provide a king pin locking plate assembly having an anti-jackknive device which is activated by the king pin on the container as it moves into a slot in the king pin locking plate.

A still further object of the invention is to provide a jaw lock which is automatically triggered by action of a jaw lock stop to lock the king pin.

A further object of the invention is to provide a jaw lock cooperatively engaged with a jaw lock stop for automatically securing or releasing the king pin.

A king pin locking plate assembly has a king pin locking plate having a longitudinally extending slot for receiving a king pin and an associated anti-jackknife bar extending from the bottom of a movable container or a trailer, the slot having an open throat to facilitate the entry of the king pin. A pair of pivot pins extend from the undersurface of the king pin locking plate and pivotally interconnect with a pair of cooperating jaws. To prevent the jaws from dropping away from the pivot pins, a support plate maintains the jaws in secured position. The jaws have frontal portions defining a lock face or a surface extending in a direction transverse to the slot and facing the open throat. Extending from the bottom of the king pin locking plate is an underframe which defines a base and a pivot bar support which is engaged by a pivot bar mounted thereon and spanning transversely across the slot or open throat. A jaw lock having a bifurcated end is pivotally supported by the pivot bar. The free end of the jaw lock is adapted to abut the lock surface on the jaws. A resilient member such as a spring is interposed between the base and the undersurface of the jaw lock to urge the free end of the jaw lock towards the lock surface. A jaw lock stop is provided in the opening between the bifurcations for selectively keeping the jaw lock in a locking position adapted to lock the king pin or in an open position adapted to release or receive the king pin when the container or trailer is moved with its king pin out of or into engagement with the king pin locking plate. The uniqueness of the present invention lies in the locking action of the jaw lock in conjunction with the automatic triggering action of the jaw lock stop.

BRIEF DESCRIPTION OF THE DRAWINGS

The construction designed to carry out the invention will be hereinafter described, together with other features thereof. The invention will be more readily understood from reading of the following specification and by reference to the accompanying drawings forming a part thereof, wherein an example of the invention is shown and wherein:

FIG. 2 is an enlarged view of an underside of the king pin locking plate taken along lines 2—2 of FIG. 1;

FIG. 3 is an enlarged fragmented portion of the king pin locking plate along the lines 3—3 in FIG. 2;

FIG. 4 is an enlarged side view of a jaw lock shown in FIG. 3;

FIG. 5 is an end view of the jaw lock shown in FIG. 4;

FIG. 6 is a side view of a jaw lock stop receivable in the bifurcated end of the jaw lock shown in FIG. 5;

FIG. 7 is a plan view of jaws cooperatively defining an opening for receiving a king pin;

FIG. 8 is a side view of the jaws shown in FIG. 7;

FIG. 9 is an enlarged view of a support plate for supporting the jaws underneath the king pin locking plate;

FIG. 12 is a horizontal section through the king pin and anti-jackknifing bar.

DESCRIPTION OF THE PREFERRED EMBODIMENT

Figures 1, 10, 11:
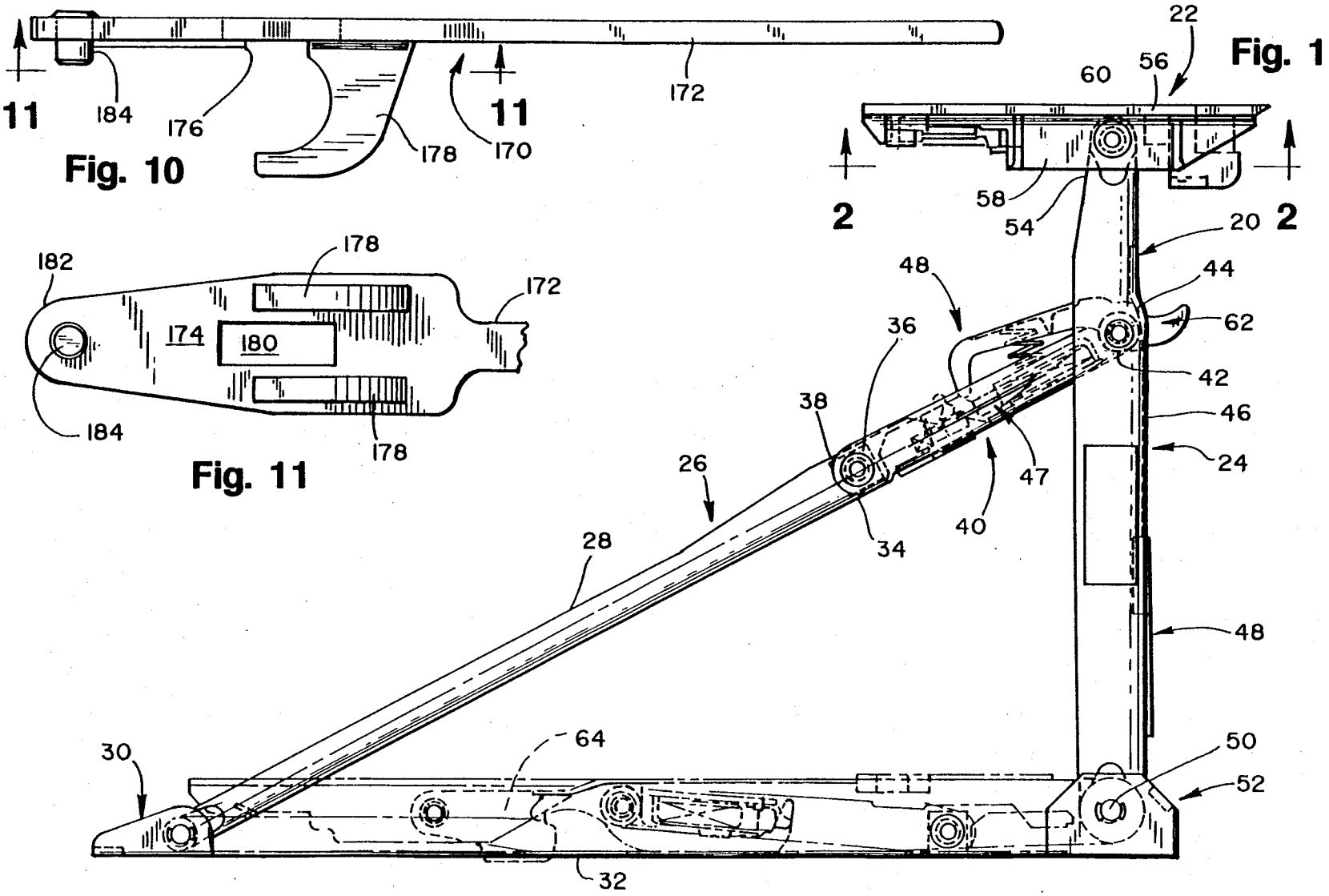
FIG. 1 shows a side view of a collapsible hitch in an erected position supporting a king pin locking plate.
FIG. 10 is a side view of a handle for unlocking the jaw lock.
FIG. 11 is a partial plan view of the unlocking handle taken along the lines 11—11 in FIG. 10.

A collapsible hitch 20 is shown in erected position in FIG. 1, wherein a king pin locking plate assembly 22 is supported by a vertical strut assembly 24 shown in its erected vertical position by a diagonal strut assembly 26 which comprises a lower portion 28 having a lower end pivotally secured by a pivot mount assembly 30 mounted on a floor or deck 32 of a ship or a carrier. An upper end of the lower portion of the strut is pivotally connected by a pin 36 to a lower end 38 of the upper strut 40 which has an upper end 42 pivotally connected by a pin 44 to a vertical strut 46. Also supported pivotally on the pin 44 is a lever assembly 48 which functions to retract a lock plunger 47 and allow the hitch 20 to collapse. The lock plunger 47 functions to maintain the hitch 20 in upright position. The vertical strut assembly 24 includes the vertical strut 48 which has a lower end pivotally connected by a pin 50 to a pivot mount assembly 52 secured to the deck 32. An upper end 54 of the vertical strut 46 is pivotally connected by a pin 56 extending through spaced walls 58 extending downwardly from the bottom of a deck plate 60 of the king pin locking plate assembly 22. The lever assembly 48 is provided with a horn 62 which, upon being struck with a bar, will then retract the lock plunger 47, causing the hitch 20 to collapse and cause the upper diagonal strut 40 to pivot counterclockwise about the pin 36. Thereupon, the vertical strut assembly 24 will likewise pivot counterclockwise about the pin 50 and effect a collapsed position of the hitch as shown in phantom position 64.

The details of the construction of the strut assemblies, the pivot mount assemblies, and the lever assembly will not be given in as much as the invention is concerned with the construction of the king pin locking plate assembly 22 provided with an anti-jackknifing device.

FIG. 2 is a view of the underside of the king pin locking plate assembly 22 as viewed along the lines 2—2 in FIG. 1. As shown, the spaced walls 58 extend downwardly from the underside of a deck plate 60 and are provided with openings 64 for receiving the pin 56. A pair of jaws 66, 68 are pivotally supported on pivot pins 70 and 72, respectively, extending out of the undersurface of the deck plate 60. To maintain the pivotal connection of the jaws with the pivot pins, there is provided a support plate 74 having an ace of spades opening 76. The support plate 74 is secured to the underside of the deck 60 by bolts 80 passing through support plate holes 81 (FIG. 9). Disposed between wing portions 82 and 84 of the jaws 68 and 66, respectively, is a spring 86 which urges the jaws 66 and 68 into an open position. As shown in FIG. 2, the jaws 66 and 68 cooperatively define an opening 88 for receiving a king pin 67 and securing it. The jaws 66 and 68 have frontal portions 90 which define an angular locking face 94 which extends transversely to a slot (cannot be seen) interconnecting with an open throat 96 which guides a king pin into the slot. The inner end of the slot overlies the opening 88 defined by the jaws 66 and 68. Subtending from a portion 98 of the deck plate 60 is a pair of walls 100, 102 which, therebetween, define a base 104. Outer ends 106 and 108 of the walls 100 and 102, respectively, are provided with bores 109 for admitting a pivot bar 110 which pivotally supports a bifurcated end 112 (FIG. 5) of a jaw lock 114.

As shown in FIG. 4, the jaw lock 114 has an upper face 116 and a lower face 118 defining therebetween, at a free end of the jaw lock, an abutting face 120 which has an angularity of about 9° with respect to a vertical. The lower face 118 is provided with a cavity 122 and a further cavity 124 which communicates with a hole 126. The bifurcated end 112 is provided with a pair of spaced openings 128 for admitting the pivot bar 110. The bifurcated end 112 comprises a pair of spaced ears 130 defining a space 132 for receiving a jaw lock stop 134 (FIG. 6) in a loose relationship so that it can move readily in the space 132. The jaw lock stop 134 has an elongated aperture 136 having semi-circular portions 138 connected by linear portions 140, thereby providing a slip motion when supported on the pivot bar 110. The jaw lock stop 134 has a locking face 142 which cooperates with a locking face 144 on the jaw lock 114. The function of the jaw lock stop 134 will be discussed later.

The support plate 74, as shown in FIG. 9, has, as previously indicated, an ace of spades opening 76, and holes 81 for admitting the bolts 80 which fasten the support plate to the underside of the deck plate 60. It is noted that a corner 148 is not symmetric with a corner 150 on the support plate 74. The support plate 74 has a pair of spaced holes 152 and 154 which receive the ends of the pivot pins 72 and 70, respectively. As mentioned before, the pivot pins 70 and 72 provide pivotal support for the jaws 66 and 68. The wing portions 82 and 84 are provided with slight depressions 156 and 158, respectively, which support therebetween the spring 86, as shown in FIG. 2. Since the depressions 156 and 158 have slightly angular faces, these contribute to the opening of the jaws 82 and 84 at all times with the spring placed between them.

Referring to FIG. 8, the jaws 66, 68 are shown in normal position as installed in the king pin locking plate assembly 22.

The wing portions 82 and 84 have upper faces having outer sides 161 which converge towards each other and end in a truncated upper edge 162. The wing portions 82 and 84 have lower faces 166 having outer sides 167 which converge toward each other and end in a truncated lower edge 169. The opening 88 defined by the two jaws 82 and 84 approximates the diameter of the king pin to be received. Extending between the upper and lower faces 164 and 160 of the jaws 82 and 84 is the angular face 94 which extends along the frontal portions 90 and 92, the angular face 94 defining an angle of about 30° with respect to a vertical.

Referring to FIG. 3, there is shown the lock jaw 114 in a locking position, wherein the abutting face 120 of the lock jaw 114 abuts the angular face 94 of the jaws 66 and 68. A spring 168 is positioned between the base 104 and the underside of the jaw lock 114, the upper end of the spring fitting into the cavity 122. The function of the spring 168 is always to urge the lock jaw in a clockwise pivotal movement. It does not provide a locking action between the angular face 94 and the abutting face 120. The locking action, as shown in FIG. 3, is effected by the jaw lock stop 134 being in an upward position so that one of its semi-circular portions 138 mates with the pivotal bar 110, the locking face 142 of the jaw lock stop 134 abutting the locking face 144 on the jaw lock 114.

In view of the mechanical interlocking between the pivotal bar 110 and the interengagement of the locking faces 142 and 144, it is not possible to release or to unlock the jaw lock 114 manually. Therefore, there is provided an unlocking handle 170 as shown in FIGS. 10 and 11. The handle 170 has a lever 172 to be grasped by the hand of an operator and a spade portion 174 provided on its underside 176 with a pair of spaced hooks 178, the spade portion 174 being provided with a rectangular aperture 180. A narrow end 182 of the spade portion 174 is provided with a position pin 184 which is adapted to be received in the hole 126 extending through the upper face 116 of the jaw lock 114, as shown best in FIG. 3. The hooks 178 are spaced from each other by a distance corresponding to the ears 130 on the bifurcated end 112 of the jaw lock 114. On the other hand, the rectangular aperture 180 is slightly wider than the space 132 between the rounded portions 186, and functions to provide an opening so as not to interfere or establish contact with the jaw lock stop 134. Assuming that the unlocking handle 170 is placed in position in FIG. 3, the hooks 178 will engage under the ears 130 and the position pin 184 will engage with the hole 126. Thereafter, when a force is applied to the lever 172 in a counterclockwise direction, the end 182 of the handle 170 will depress the jaw lock 114 in a counterclockwise direction. As the applied force is increased, the jaw lock stop 134 will slip downwardly to release the contact between the locking faces 142 and 144. After the jaw lock is depressed to substantially a horizontal position, as indicated in the position 188 shown in phantom, the jaw lock stop will now function to maintain the jaw lock 114 in its horizontal position by re-establishing contact between the locking faces 144 and 142. During this operation, the spring 178 is compressed more further. When the jaw lock 114 is unlocked, as shown in phantom position 188 in FIG. 3, the jaws 90 and 92 will automatically open because of its associated spring 86. The trailer or container with its king pin can now be moved off the king pin locking plate assembly 22.

If the hitch 20 is in its erected position and it is desired to couple the trailer or the container with its associated king pin to the king pin locking plate assembly 22, the unlocking handle 170 is positioned again about the jaw lock 114 and a counterclockwise force is applied to the lever 172 causing the phantom position 188 of the jaw lock 114 to slightly dip downward at its end 120. At this time, a force is applied manually to a lower portion 190 on the jaw lock stop 134 (FIG. 6) to slide the jaw lock stop into its upper position, as shown in FIG. 3. At this time, the abutting face 120 on the free end of the jaw lock 114 will pivot clockwise to the position shown in FIG. 3. During this time, the jaws 66 and 68 will remain in their open position because of the spring 86 interacting therebetween. As the king pin on the carrier or the trailer moves through the open throat 96 into the slot in the deck plate 60, the free end of the king pin will slide over the upper face 116 of the jaw lock 114, depressing it downwardly so that the upper face 116 on the jaw lock 114 is slightly below the plane occupied by the lower faces 166 of the jaws 66 and 68. At this time, as mentioned before, the jaws remain in their wide-open position so that, as the king pin enters into the position occupied by opening 88, points 192 on the jaws 66 and 68, as shown in FIG. 7, will be the foremost portions of the jaws to be struck by the king pin, causing the jaws to converge together and clasp the king pin. As soon as the clamping is completed, the jaw lock 114, no longer depressed by the king pin, will spring upward, and its abutting face 120 will perform a locking function against the angular face 94 on the jaws 66 and 68.

The deck plate 60 has a slot 300 which admits the cylindrical king pin 67 into the closed end portion 302 for association with the locking mechanism. The king pin 67 is located at the forward end of the trailer and depends therefrom and is disposed ahead of the anti-jackkniving bar 304 which depends from and is connected to a bottom of the trailer. The bar has a close fit in the slot 300 and has parallel sides 306, 308 which lie in close proximity to the parallel sides 310, 312 of the slot 300 which prevents the trailer from jackkniving about the king pin 67.

Normally, the hitch 20 is in its collapsed position on a deck 32. The container or trailer is coupled to a special tractor which backs the trailer over the collapsed hitch, which is then hooked to the back end of the tractor which, upon forward movement, will raise the hitch to its erected position simultaneously with the forward movement of the trailer. At this point, the jaw lock 114 is unlocked as described previously by using the unlocking tool 170 to place the jaw lock 114 in the position shown in FIG. 3. At this point, the tractor moves backwardly the trailer so that its king pin lies over the upper face 116 of the jaw lock 114, thereby depressing the jaw lock 114 to remove its abutting face 120 from contact with the angular locking face 94. Thereafter, the king pin moves into the opening 88 and the jaws 66 and 68 clapse the king pin. Thereafter, the tractor drives away.

In order to unload the trailer from its coupled position with the king pin locking plate, the unlocking tool 170 is used to unlock the jaw lock 114, as previously described. The tractor is then backed up to the hitch 20, causing a plate on the rear of the tractor to contact the horn 62 which, in turn, activates the lever assembly 48. The lever assembly 48 then retracts the lock plunger 47, causing the hitch to collapse. The trailer, which has been supported by the hitch 20, is now supported by the plate on the tractor which continues to back up until it engages the king pin on the trailer, and then it drives away. As the hitch 20 collapses to the deck 32, the lower portion 190, shown in phantom, of the lock jaw stop 134, contacts the deck 32 and is pushed upwardly, allowing the jaw lock 114 to return to the locked position with the jaws 66 and 68 being in open position.

While a preferred embodiment of the invention has been described using specific terms, such description is for illustrative purposes only, and it is to be understood that changes and variations may be made without departing from the spirit or scope of the following claims.

What is claimed is:

1. In a collapsible hitch adapted to secure a king pin extending from a container or a trailer, comprising a king pin locking plate assembly adapted to receive said king pin on said container, said king pin locking assembly being mounted on a collapsible strut arrangement, said king pin locking assembly comprising lock plate means supporting a pair of spaced jaw members, bias means biasing said jaw members to an open position, said jaw members cooperatively defining a locking face, base means extending from said lock plate means, pivot bar means extending transversely through said base means and pivotally supporting jaw lock means, a free end of said jaw lock means defining an abutting face for engaging said locking face, spring means biasing said jaw lock means toward engagement with said jaw members, and a jaw lock stop means cooperatively engaged with said jaw locking means and said pivot bar means for placing said jaw lock means in contact with said locking face and alternatively out of contact therewith wherein said jaw lock means has a bifurcated end engaging said pivot bar means, said bifurcated end having spaced rounded portions defining therebetween a slot provided with a locking face, said jaw lock stop means having a rounded configuration terminating in a locking face for slidable locking engagement with said slot locking face, said jaw lock stop means having an elongated aperture transfixed by said pivot bar means, said aperture having semi-circular end alternately engageable with said pivot bar means, said jaw lock stop means being slidably movable transversely to a longitudinal axis of said pivot bar means for upsetting said slot locking face into two positions with respect to said pivot bar means.

2. In a collapsible hitch adapted to secure a king pin extending from a container or a trailer, comprising a king pin locking plate assembly adapted to receive said king pin on said container, said king pin locking assembly being mounted on a collapsible strut arrangement, said king pin locking assembly comprising lock plate means supporting a pair of spaced jaw members, bias means biasing said jaw members to an open position, said jaw members cooperatively defining a locking face, base means extending from said lock plate means, pivot bar means extending transversely through said base means and pivotally supporting jaw lock means, a free end of said jaw lock means defining an abutting face for engaging said locking face, spring means biasing said jaw lock means toward engagement with said jaw members, and a jaw lock stop means cooperatively engaged with said jaw locking means and said pivot bar means for placing said jaw lock means in contact with said locking face and alternatively out of contact therewith, wherein said jaw members have a pair of wing portions, each provided with a pivot hole engaged by a pivot pin extending from said lock plate means, said wing portions having an upper face having lower sides converging toward each other and terminating in a short truncated edge, said wing portions having a lower face having converging linear sides and terminating in a long truncated edge, said short and long edges being angularly spaced from each other and defining therebetween said locking face.

3. A king pin locking assembly according to claim 2, wherein the locking face is directed downwardly and defines an angle of about 30° with respect to a vertical.

4. A king pin locking assembly according to claim 2, wherein said wing portions have common sides facing each other, each side having a semi-circular cut-out, the cut-outs defining therebetween an opening for securing the king pin.

5. A king pin locking plate assembly, comprising a king pin locking plate having a longitudinally extending slot for receiving a king pin on a movable container, said slot having an open throat to facilitate the entry of the king pin, pivot means extending below said king pin locking plate, jaw means pivotably engaged with said pivot means, support means for maintaining said jaw means pivotally secured with said pivot means, bias means for maintaining said jaw means open and adapted to receive said king pin, said jaw means having on a frontal portion a lock surface extending in a direction transverse to said slot and facing said open that, underframe means subtending from the undersurface of said locking plate and defining a base and pivot bar support means, a pivot bar mounted on said pivot bar support means and spanning transversely across said open throat, jaw lock means having a bifurcated end pivotally supported by said pivot bar and a free end adapted to abut said lock surface, resilient means interposed between said base and an undersurface of said jaw lock means, for urging said free end towards said lock surface, and jaw lock stop means associated with said bifurcated end and the pivot bar for selectively keeping said free end abutting the lock surface on said jaw lock means to keep said jaw means locked in king pin engaging position, wherein said jaw lock stop means comprises an elongated ring-like member having a flat locking face, an elongated aperture defined by a pair of spaced opposed semi-circular portions joined by a pair of spaced linear portions, and a lower portion extending below one of said semi-circular portions, said member having its semi-circular portions in contact with said pivot bar and alternatively out of contact therewith.

6. A king pin locking plate assembly according to claim 5, wherein the bifurcated end of said jaw lock means is provided with a locking face adapted to mate with the flat locking face of said member to maintain said jaw lock means in a locked cooperation with said jaw means when said member is in contact with said pivot bat.

* * * * *